US012654831B2

(12) United States Patent
Nogami

(10) Patent No.: US 12,654,831 B2
(45) Date of Patent: Jun. 16, 2026

(54) MARINE PROPULSION DEVICE AND MARINE VESSEL

(71) Applicant: YAMAHA HATSUDOKI KABUSHIKI KAISHA, Iwata (JP)

(72) Inventor: Tatsuhiko Nogami, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 378 days.

(21) Appl. No.: 18/404,947

(22) Filed: Jan. 5, 2024

(65) Prior Publication Data

US 2024/0239465 A1 Jul. 18, 2024

(30) Foreign Application Priority Data

Jan. 13, 2023 (JP) ..... 2023-003791

(51) Int. Cl.

| | |
|---|---|
| ***B63H 21/17*** | (2006.01) |
| ***B63H 21/21*** | (2006.01) |
| ***B63H 23/24*** | (2006.01) |

(52) U.S. Cl.

CPC ..... *B63H 21/17* (2013.01); *B63H 23/24* (2013.01); *B63H 2021/216* (2013.01)

(58) Field of Classification Search

CPC ..... B63H 21/17; B63H 5/15; B63H 20/007; B63H 20/12; B63H 23/24; B63H 2021/216

USPC ..... 440/1, 6, 49, 53, 61 S, 76, 77, 78, 84

See application file for complete search history.

(56) References Cited

U.S. PATENT DOCUMENTS

| | | | | |
|---|---|---|---|---|
| 2002/0013106 | A1* | 1/2002 | Healey | G01S 7/521 440/6 |
| 2020/0247519 | A1* | 8/2020 | Fujino | B63H 25/02 |
| 2021/0197944 | A1* | 7/2021 | Takase | B63H 5/125 |
| 2022/0017201 | A1* | 1/2022 | Takeda | B63H 1/14 |

FOREIGN PATENT DOCUMENTS

| | | | |
|---|---|---|---|
| EP | 1921311 | A1 | 5/2008 |
| EP | 3939880 | A1 | 1/2022 |
| JP | 2020-125067 | A | 8/2020 |
| JP | 2021-104715 | A | 7/2021 |
| JP | 2022-18647 | A | 1/2022 |

OTHER PUBLICATIONS

Official Communication issued in corresponding European Patent Application No. 23218000.0, mailed on May 31, 2024, 8 pages.

* cited by examiner

*Primary Examiner* — Tye William Abell

(74) *Attorney, Agent, or Firm* — Keating & Bennett, LLP

(57) ABSTRACT

A marine propulsion device includes an electric motor; a motor controller; a case to house the motor controller; a steering mechanism to integrally rotate a propeller, the electric motor, and the case in a right-left direction; and two power lines including first ends connected to the motor controller, and positive and negative lines to supply driving electric power to the motor controller. The two power lines are twisted together so as to absorb twisting of the two power lines during rotation by the steering mechanism.

16 Claims, 2 Drawing Sheets

MARINE PROPULSION DEVICE AND MARINE VESSEL

CROSS REFERENCE TO RELATED APPLICATIONS

This application claims the benefit of priority to Japanese Patent Application No. 2023-003791 filed on Jan. 13, 2023. The entire contents of this application are hereby incorporated herein by reference.

BACKGROUND OF THE INVENTION

1. Field of the Invention

The present invention relates to marine propulsion devices and marine vessels.

2. Description of the Related Art

A marine propulsion device including a steering mechanism that rotates a propeller in a right-left direction is known in general. Such a marine propulsion device is disclosed in Japanese Patent Laid-Open No. 2022-018647, for example.

Japanese Patent Laid-Open No. 2022-018647 discloses an electric marine propulsion device including a steering mechanism and to be attached to a stern of a hull. The marine propulsion device includes a motor controller that controls driving of an electric motor of a propeller, a housing that houses the motor controller and is provided at the rear of the hull, and a power cable. The power cable extends the hull side into the housing located at the rear of the hull and is connected to the motor controller. The steering mechanism rotates the housing in which the motor controller is housed in the right-left direction together with the propeller.

However, in the field of conventional marine propulsion devices including the marine propulsion device disclosed in Japanese Patent Laid-Open No. 2022-018647, it is known that a relatively large load acts on a power cable connected to a motor controller when the power cable is twisted from an untwisted state when a steering mechanism rotates a propeller in a right-left direction. Therefore, it is conventionally desired to decrease the load on the power cable connected to the motor controller when the steering mechanism rotates the propeller in the right-left direction.

SUMMARY OF THE INVENTION

Example embodiments of the present invention provide marine propulsion devices and marine vessels that each decrease loads on power lines connected to motor controllers when steering mechanisms rotate propellers in a right-left direction.

A marine propulsion device according to an example embodiment of the present invention includes a propeller; an electric motor to drive the propeller; a motor controller configured or programmed to control driving of the electric motor; a case to house the motor controller; a steering mechanism to integrally rotate the propeller, the electric motor, and the case in a right-left direction;, and two power lines including first ends connected to the motor controller, and positive and negative lines to supply driving electric power to the motor controller. The two power lines are twisted together inside at least the case so as to absorb twisting of the two power lines during rotation by the steering mechanism.

A marine propulsion device according to an example embodiment of the present invention includes the two power lines including the positive and negative lines to supply driving electric power to the motor controller, and the two power lines are twisted together inside at least the case so as to absorb the twisting during rotation by the steering mechanism. Accordingly, when the propeller is rotated in the right-left direction by the steering mechanism, the amount of twisting of the two power lines is decreased when the propeller is rotated to at least a first side in the right-left direction, and thus loads on the two power lines are reduced or prevented. Therefore, as compared with a conventional structure in which the amount of twisting of power lines increases (loads increase) even when a propeller is rotated in either a right or left direction, loads on the power lines connected to the motor controller are decreased when the propeller is rotated in the right-left direction by the steering mechanism.

In a marine propulsion device according to an example embodiment of the present invention, in a neutral state in which a direction of a thrust of the propeller is parallel to a forward-rearward direction of a hull, the two power lines are preferably spaced apart by a distance that allows an amount of twisting to be increased during the rotation by the steering mechanism. Accordingly, there is a distance between the two power lines that allows the amount of twisting to be increased during rotation by the steering mechanism as the distance between the two power lines becomes smaller, and thus loads on the power lines connected to the motor controller during rotation by the steering mechanism are decreased.

In such a case, the amount of twisting of the two power lines preferably increases as the two power lines become closer together in a direction perpendicular to a direction in which the two power lines extend when the case is rotated from the neutral state to a first side in the right-left direction by the steering mechanism, and the amount of twisting of the two power lines preferably decreases as the two power lines become farther apart in the direction perpendicular to the direction in which the two power lines extend when the case is rotated from the neutral state to a second side in the right-left direction by the steering mechanism. Accordingly, the two power lines become farther apart in the direction perpendicular to the direction in which the two power lines extend such that twisting forces acting on the two power lines are decreased. Consequently, loads on the power lines connected to the motor controller during rotation by the steering mechanism are further decreased.

In a marine propulsion device according to an example embodiment of the present invention, the steering mechanism preferably includes a cylindrical steering shaft, and the two power lines preferably extend through the cylindrical steering shaft in a mutually twisted state so as to absorb the twisting during the rotation by the steering mechanism. Accordingly, the two power lines extend through the cylindrical steering shaft, and thus deformation of the two power lines into shapes different from shapes along the steering shaft, such as a large deformation of only portions of the two power lines, occurring during rotation by the steering mechanism is reduced or prevented.

In such a case, the cylindrical steering shaft preferably extends in an upward-downward direction, and the two power lines preferably include twisted portions extending linearly in the upward-downward direction along an axial center of the cylindrical steering shaft. Accordingly, the two power lines extend linearly in the upward-downward direction along the axial center of the cylindrical steering shaft, and thus as compared with a case in which the two power lines include bent or curved portions, loads on the power lines connected to the motor controller during rotation by the steering mechanism are further decreased.

In a marine propulsion device according to an example embodiment of the present invention, the case preferably includes an upper case and a lower case below the upper case to house the motor controller, the steering mechanism is preferably operable to integrally rotate the propeller, the electric motor, and the lower case in the right-left direction with respect to the upper case, and the two power lines preferably include upper ends of twisted portions inside the upper case, and lower ends of the twisted portions inside the lower case. Accordingly, even when the two power lines straddle the upper case that does not rotate and the lower case that does rotate, loads on the power lines connected to the motor controller during rotation by the steering mechanism are decreased.

In such a case, a marine propulsion device preferably further includes an upper restrainer to bundle and restrain the upper ends of the twisted portions of the two power lines within the upper case, and a lower restrainer to bundle and restrain the lower ends of the twisted portions of the two power lines within the lower case. Accordingly, the amount of twisting of the two power lines is maintained at an appropriate amount between the upper restrainer and the lower restrainer.

In a marine propulsion device including the upper restrainer and the lower restrainer, the lower restrainer is preferably fixed to an inner surface of the lower case. Accordingly, the lower restrainer allows the amount of twisting of the lower ends of the twisted portions of the two power lines to be maintained at an appropriate amount up to the location of the inner surface of the lower case.

In a marine propulsion device including the upper restrainer and the lower restrainer, the upper case preferably includes a steering box including the steering mechanism therein, and a cowling above the steering box, the marine propulsion device preferably further includes a terminal case inside the cowling connected to second ends of the two power lines, and the upper restrainer is preferably fixed to the terminal case. Accordingly, the upper restrainer allows the amount of twisting of the upper ends of the twisted portions of the two power lines to be maintained at an appropriate amount up to the location of the terminal case.

In a marine propulsion device including the upper restrainer and the lower restrainer, both the upper restrainer and the lower restrainer are preferably made of an elastically deformable material. Accordingly, the upper restrainer and the lower restrainer are elastically deformed, and thus damage to the two power lines by the upper restrainer and the lower restrainer is prevented.

In a marine propulsion device including the upper restrainer and the lower restrainer, the lower restrainer is preferably located at a height between an upper end of the motor controller and a lower end of the motor controller, and the two power lines preferably extend toward the motor controller while curving along a horizontal or substantially horizontal direction below the lower restrainer. Accordingly, the two power lines are easily connected to the motor controller by being located relatively close to the motor controller below the lower restrainer.

A marine propulsion device including the upper restrainer and the lower restrainer preferably further includes a signal line connected to the motor controller to transmit a control signal to the motor controller, and that is thinner than each of the two power lines, the signal line is preferably located along the two power lines without being twisted with the two power lines, and the upper restrainer and the lower restrainer are preferably operable to bundle and restrain the signal line together with the two power lines. Accordingly, the signal line is located along the two power lines between the upper restrainer and the lower restrainer, and thus interference of expansion and contraction of the twisting of the two power lines by the signal line due to partial deformation of the signal line caused by the twisting between the upper restrainer and the lower restrainer is reduced or prevented.

A marine propulsion device according to an example embodiment of the present invention preferably further includes a cylindrical duct attached to a lower portion of the case and including the propeller therein, and the electric motor preferably includes a stator in the duct and a rotor in the propeller. Accordingly, in the duct-driven marine propulsion device in which the electric motor is provided in the duct and the propeller, loads on the power lines connected to the motor controller during rotation by the steering mechanism are decreased.

A marine vessel according to an example embodiment of the present invention includes a hull, and a marine propulsion device attached to the hull. The marine propulsion device includes a propeller; an electric motor to drive the propeller; a motor controller configured or programmed to control driving of the electric motor; a case to house the motor controller; a steering mechanism to integrally rotate the propeller, the electric motor, and the case in a right-left direction; and two power lines including first ends connected to the motor controller, and positive and negative lines to supply driving electric power to the motor controller. The two power lines are twisted together inside at least the case so as to absorb twisting of the two power lines during rotation by the steering mechanism.

A marine vessel according to an example embodiment of the present invention includes the two power lines including the positive and negative lines to supply driving electric power to the motor controller, and the two power lines are twisted together inside at least the case so as to absorb twisting during rotation by the steering mechanism. Accordingly, when the propeller is rotated in the right-left direction by the steering mechanism, the amount of twisting of the two power lines is decreased when the propeller is rotated to at least a first side in the right-left direction, and thus loads on the two power lines are reduced or prevented. Therefore, as compared with a conventional structure in which the amount of twisting of the power lines increases (loads increase) even when a propeller is rotated in either a right or left direction, loads on the power lines connected to the motor controller are decreased when the propeller is rotated in the right-left direction by the steering mechanism.

In a marine vessel according to an example embodiment of the present invention, in a neutral state in which a direction of a thrust of the propeller is parallel to a forward-rearward direction of the hull, the two power lines are preferably spaced apart by a distance that allows an amount of twisting to be further increased during the rotation by the steering mechanism. Accordingly, there is a distance between the two power lines that allows the amount of twisting to be increased during rotation by the steering mechanism as the distance between the two power lines becomes smaller, and thus loads on the power lines connected to the motor controller during rotation by the steering mechanism are decreased.

In such a case, the amount of twisting of the two power lines preferably increases as the two power lines become closer together in a direction perpendicular to a direction in which the two power lines extend when the case is rotated from the neutral state to a first side in the right-left direction by the steering mechanism, and the amount of twisting of the two power lines preferably decreases as the two power lines become farther apart in the direction perpendicular to the direction in which the two power lines extend when the case is rotated from the neutral state to a second side in the right-left direction by the steering mechanism. Accordingly, the two power lines become farther apart in the direction perpendicular to the direction in which the two power lines extend such that twisting forces acting on the two power lines are decreased. Consequently, loads on the power lines connected to the motor controller during rotation by the steering mechanism are further decreased.

In a marine vessel according to an example embodiment of the present invention, the steering mechanism preferably includes a cylindrical steering shaft, and the two power lines preferably extend through the cylindrical steering shaft in a mutually twisted state so as to absorb the twisting during the rotation by the steering mechanism. Accordingly, the two power lines extend through the cylindrical steering shaft, and thus deformation of the two power lines into shapes different from shapes along the steering shaft, such as a large deformation of only portions of the two power lines, occurring during rotation by the steering mechanism is reduced or prevented.

In such a case, the cylindrical steering shaft preferably extends in an upward-downward direction, and the two power lines preferably include twisted portions extending linearly in the upward-downward direction along an axial center of the cylindrical steering shaft. Accordingly, the two power lines extend linearly in the upward-downward direction along the axial center of the cylindrical steering shaft, and thus as compared with a case in which the two power lines include bent or curved portions, loads on the power lines connected to the motor controller during rotation by the steering mechanism are further decreased.

In a marine vessel according to an example embodiment of the present invention, the case preferably includes an upper case and a lower case below the upper case to house the motor controller, the steering mechanism is preferably operable to integrally rotate the propeller, the electric motor, and the lower case in the right-left direction with respect to the upper case, and the two power lines preferably include upper ends of twisted portions inside the upper case, and lower ends of the twisted portions inside the lower case. Accordingly, even when the two power lines straddle the upper case that does not rotate and the lower case that does rotate, loads on the power lines connected to the motor controller during rotation by the steering mechanism are decreased.

In such a case, the marine propulsion device preferably further includes an upper restrainer to bundle and restrain the upper ends of the twisted portions of the two power lines within the upper case, and a lower restrainer to bundle and restrain the lower ends of the twisted portions of the two power lines within the lower case. Accordingly, the amount of twisting of the two power lines is maintained at an appropriate amount between the upper restrainer and the lower restrainer.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Example embodiments of the present invention are hereinafter described with reference to the drawings.

Figure 1:
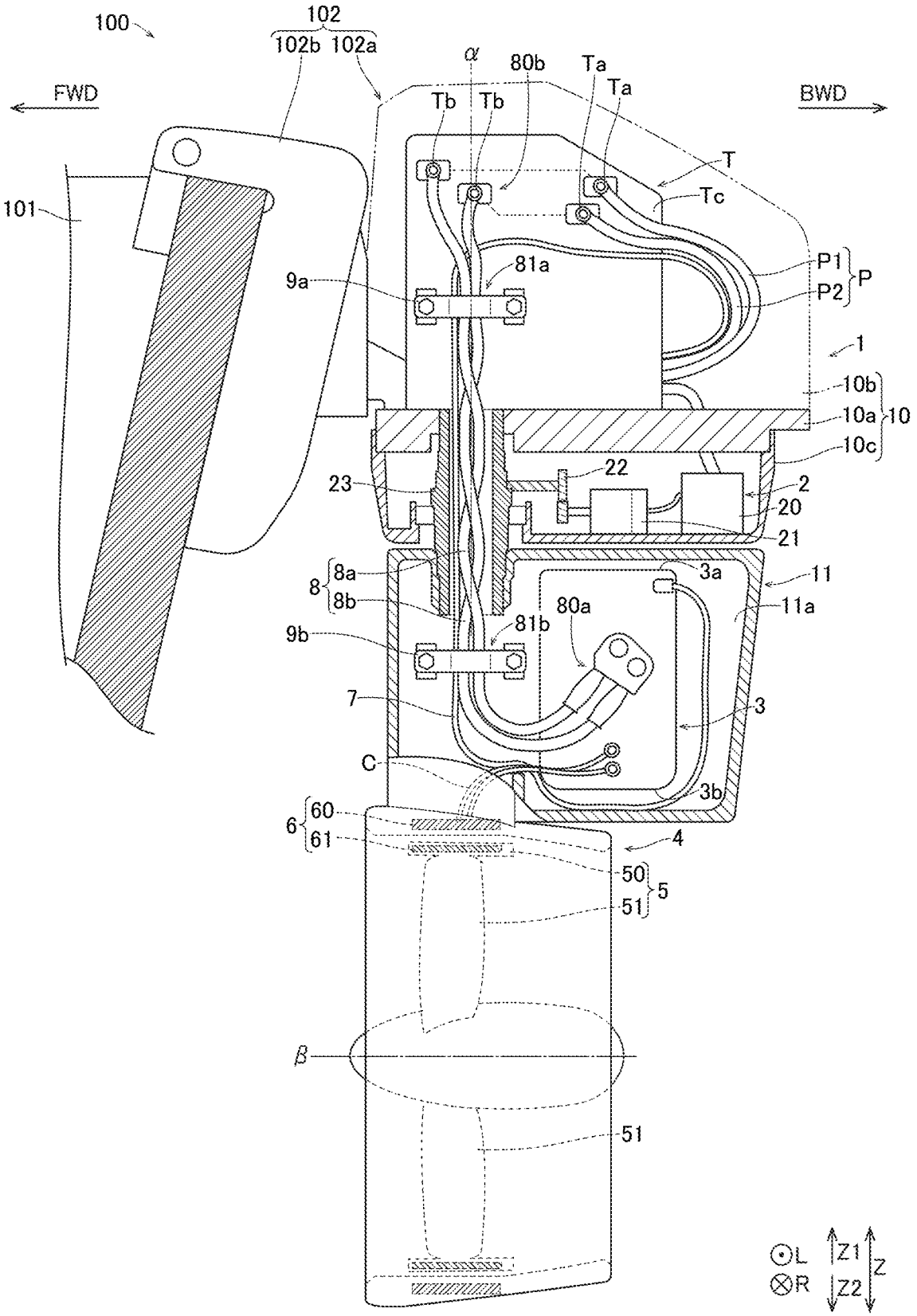
FIG. 1 is a side view showing a marine vessel including a marine propulsion device according to an example embodiment of the present invention from the right side.

The structure of a marine vessel 100 including a marine propulsion device 102 according to example embodiments of the present invention is now described with reference to FIGS. 1 and 2.

In the figures, arrow FWD represents the forward movement direction of the marine vessel 100, arrow BWD represents the reverse movement direction of the marine vessel 100, and arrow R represents the starboard side (right side) of the marine vessel 100, and arrow L represents the port side (left side) of the marine vessel 100.

In the figures, arrow Z represents an upward-downward direction, arrow Z1 represents an upward direction, and arrow Z2 represents a downward direction. A Z direction is also a direction along the axial center $\alpha$ of a steering shaft 23.

In the figures, arrow RO1 represents the counterclockwise (left-handed) rotation direction of a propeller 5, for example, by a steering mechanism 2, and arrow RO2 represents the clockwise (right-handed) rotation direction of the propeller 5, for example, by the steering mechanism 2.

The marine vessel 100 includes a hull 101 and a marine propulsion device 102.

The marine propulsion device 102 is attached to a transom of the hull 101 from the rear and includes an outboard motor provided outside the hull 101. Furthermore, the marine propulsion device 102 is an electric propulsion device that drives the propeller 5 using an electric motor 6. The marine propulsion device 102 is a duct-driven propulsion device in which the electric motor 6 is integral and unitary with a duct 4 and the propeller 5.

Driving electric power for propulsion (to drive the propeller 5) is supplied by power supply lines P extending into the marine propulsion device 102 from the hull 101. The power supply lines P include a positive line P1 and a negative line P2. First ends of the power supply lines P are connected to a terminal case T of the marine propulsion device 102. Second ends of the power supply lines P are located in the hull 101.

The marine propulsion device 102 includes a propulsion device body 102*a* and a bracket 102*b* to attach the propulsion device body 102*a* to the hull 101.

The propulsion device body 102*a* includes a case 1, the terminal case T, the steering mechanism 2, a motor controller 3 (so-called motor control unit), the duct 4, the propeller 5, the electric motor 6 that drives the propeller 5, a signal line 7, two power lines 8 including a positive line 8*a* and a negative line 8*b*, an upper restrainer 9*a*, and a lower restrainer 9*b*.

First ends 80*a* of the two power lines 8 are connected to the motor controller 3, and second ends 80*b* are connected to the terminal case T. The two power lines 8 supply the driving electric power to the motor controller 3 to drive the propeller 5. The motor controller 3 is rotated in a right-left direction by the steering mechanism 2, while the terminal case T is not rotated in the right-left direction by the steering mechanism 2.

In example embodiments of the present invention, the two power lines 8 are twisted together inside at least the case 1 (lower case 11) so as to absorb twisting during rotation by the steering mechanism 2. In short, the two power lines 8 are twisted together in advance, when the steering mechanism 2 is in a neutral state in which the direction of the thrust of the propeller 5 is parallel to the forward-rearward direction of the hull 101, such that during rotation by the steering mechanism 2, excessive loads caused by the twisting are not applied.

The case 1 includes an upper case 10 and the lower case 11 located below the upper case 10.

The upper case 10 includes a base 10*a*, a removable cowling 10*b* attached to the base 10*a* from above, and a steering box 10*c* fixed to the base 10*a* from below.

The bracket 102*b* is directly fixed to the base 10*a*. The base 10*a* is attached to the hull 101 via the bracket 102*b*. Therefore, the upper case 10 is attached to the hull 101 via the base 10*a* and the bracket 102*b*, and is not rotated in the right-left direction by the steering mechanism 2. The base 10*a*supports the entire propulsion device body 102*a*. The terminal case T is located on the base 10*a*.

The cowling 10*b* is a hollow lid member, and protects the terminal case T etc. on the base 10*a* by covering the terminal case T etc. The cowling 10*b* is provided above the steering box 10*c*.

The steering mechanism 2 is located inside the steering box 10*c*. The steering box 10*c* has a streamlined shape in which the front portion is rounded and the rear portion is thinner than the front portion.

The motor controller 3 is located inside the lower case 11. The lower case 11 is supported by the steering shaft 23 of the steering mechanism 2. The lower case 11 is connected to the steering box 10*c* located above via the steering shaft 23. The duct 4 is fixed to a lower portion of the steering box 10*c*via the lower case 11.

The second ends 80*b* of the two power lines 8 including the first ends 80*a* connected to the motor controller 3 are connected to the terminal case T.

Specifically, the terminal case T includes terminals Ta and terminals Tb. The power supply lines P are connected to the terminals Ta to supply power from the hull 101. The second ends 80*b* of the two power lines 8 are connected to the terminals Tb.

The terminals Ta and the terminals Tb are electrically connected to each other. Therefore, the power supply lines P connected to the terminals Ta and the two power lines 8 connected to the terminals Tb are electrically connected to each other. In short, the driving electric power to drive the propeller 5 is transmitted to the power supply lines P, the terminals Ta, the terminals Tb, the two power lines 8, and the motor controller 3 in this order, and the electric motor 6 (propeller 5) is driven by the motor controller 3.

The steering mechanism 2 integrally rotates the propeller 5, the electric motor 6, and the case 1 (lower case 11) in the right-left direction. The steering mechanism 2 integrally rotates the propeller 5, the electric motor 6, and the lower case 11 in the right-left direction with respect to the upper case 10.

The steering mechanism 2 includes a steering controller 20 (so-called steering control unit), a steering motor 21, a torque transmission 22, and the steering shaft 23.

The steering controller 20 includes a CPU, a memory, etc. The steering controller 20 performs a control to drive the steering motor 21 based on an operation signal from a steering wheel, for example, and rotate the propeller 5, for example, in the right-left direction.

The torque transmission 22 transmits the torque of the steering motor 21 to the steering shaft 23 to rotate the steering shaft 23. As an example, the torque transmission 22 includes various gears such as a worm gear.

The steering shaft 23 is cylindrical. The cylindrical steering shaft 23 extends in the upward-downward direction. That is, the axial center α of the steering shaft 23 extends in the upward-downward direction. The steering shaft 23 is supported by the upper case 10 so as to be rotatable with respect to the upper case 10.

The lower end of the steering shaft 23 is located inside the lower case 11. That is, the lower end of the steering shaft 23 extends to a location below the upper surface of the lower case 11. Furthermore, the lower end of the steering shaft 23 is located below the upper surface of the motor controller 3 and above the lower surface of the motor controller 3. That is, the lower end of the steering shaft 23 is located on the side of the motor controller 3.

The motor controller 3 includes a CPU, a memory, etc. The motor controller 3 is located inside the lower case 11, as described above. The first ends 80*a* (lower ends) of the two power lines 8 including the positive line 8*a* and the negative line 8*b* are connected to the motor controller 3. The motor controller 3 is connected to a stator 60 provided in the duct 4 via various types of wiring C (e.g., wiring to supply power and wiring to transmit a control signal).

The duct 4 is attached to a lower portion of the lower case 11. The duct 4 is cylindrical. The central axis of the cylindrical duct 4 extends horizontally. The propeller 5 is located inside the duct 4 such that the rotation central axis β of the propeller 5 coincides with the central axis of the duct 4.

The propeller 5 includes a rim 50 and a plurality of blades 51. The rim 50 has a cylindrical shape that is smaller than the duct 4. The rim 50 is disposed along the annular inner peripheral surface of the duct 4. The blades 51 are located inside the rim 50. The plurality of blades 51 extend radially from the rotation central axis β.

The electric motor 6 is, for example, a synchronous motor. The electric motor 6 includes the stator 60 and a rotor 61.

The stator 60 is integral and unitary with the duct 4. Specifically, the stator 60 includes a plurality of stator coils covered with a resin of the duct 4, for example. The rotor 61 is an inner rotor located inside the stator 60. The rotor 61 is integral and unitary with the rim 50 of the propeller 5. Specifically, the rotor 61 includes a plurality of permanent magnets covered with a resin of the rim 50, for example. The electric motor 6 rotates the propeller 5 by generating a rotating magnetic field to rotate the rotor 61 (propeller 5) when the stator 60 is energized.

The signal line 7 extends through the cylindrical steering shaft 23. That is, the signal line 7 extends from inside the cowling 10*b* into the lower case 11 along the two power lines 8. The signal line 7 is preferably not twisted with respect to (i.e., together with) the two power lines 8 that are twisted together. The signal line 7 is connected to the motor controller 3 within the lower case 11. The signal line 7 transmits, to the motor controller 3, a control signal to drive and control the electric motor 6. The signal line 7 includes a bundle of multiple thin wires. As an example, the signal line 7 includes a bundle of sixteen thin wires. In the drawings, the signal line 7 is simplified and shown as one line.

The signal line 7 is thinner than each of the positive line 8*a* and the negative line 8*b* of the two power lines 8. As an example, the sectional area of the signal line 7 is about one-fourth of the sectional area of each of the positive line 8*a* and the negative line 8*b*. In such a case, the diameter of the signal line 7 is one-sixth or less of the diameter of each of the positive line 8*a* and the negative line 8*b*. In short, the signal line 7 is stronger against a load caused by twisting than the two power lines 8 (the positive line 8*a* and the negative lines 8*b*). As an example, the sectional area of one thin wire of the signal line 7 is 1/100 or more and 1/15 or less of the sectional area of each of the positive line 8*a* and the negative line 8*b*.

The upper restrainer 9*a* is provided inside the upper case 10 (cowling 10*b*). The upper restrainer 9*a* bundles and restrains the upper ends 81*a* of twisted portions of the two power lines 8 within the upper case 10.

The upper restrainer 9*a* is fixed to the outer surface Tc of the terminal case T within the cowling 10*b*. As an example, the upper restrainer 9*a* is fixed to the outer surface Tc of the terminal case T by a fastener such as a screw.

The upper restrainer 9*a* is made of an elastically deformable material so as not to damage the two power lines 8 restrained thereby. As an example, the upper restrainer 9*a*includes a rubber grommet. The rubber grommet of the upper restrainer 9*a* absorbs twisting of the two power lines 8 by elastically deforming during rotation by the steering mechanism 2. Furthermore, the upper restrainer 9*a* bundles and restrains the signal line 7 together with the two power lines 8.

The lower restrainer 9*b* is provided inside the lower case 11. The lower restrainer 9*b* is located at a height between the upper end 3*a* of the motor controller 3 and the lower end 3*b*of the motor controller 3. The lower restrainer 9*b* bundles and restrains the lower ends 81*b* of the twisted portions of the two power lines 8 within the lower case 11.

The lower restrainer 9*b* is fixed to the inner surface 11*a* of the lower case 11 within the lower case 11. As an example, the lower restrainer 9*b* is fixed to the inner surface 11*a* of the lower case 11 by a fastener such as a screw.

The lower restrainer 9*b* is made of an elastically deformable material so as not to damage the two power lines 8 restrained thereby. As an example, the lower restrainer 9*b*includes a rubber grommet. The rubber grommet of the lower restrainer 9*b* absorbs twisting of the two power lines 8 by elastically deforming during rotation by the steering mechanism 2. Furthermore, the lower restrainer 9*b* bundles and restrains the signal line 7 together with the two power lines 8.

Figure 2:
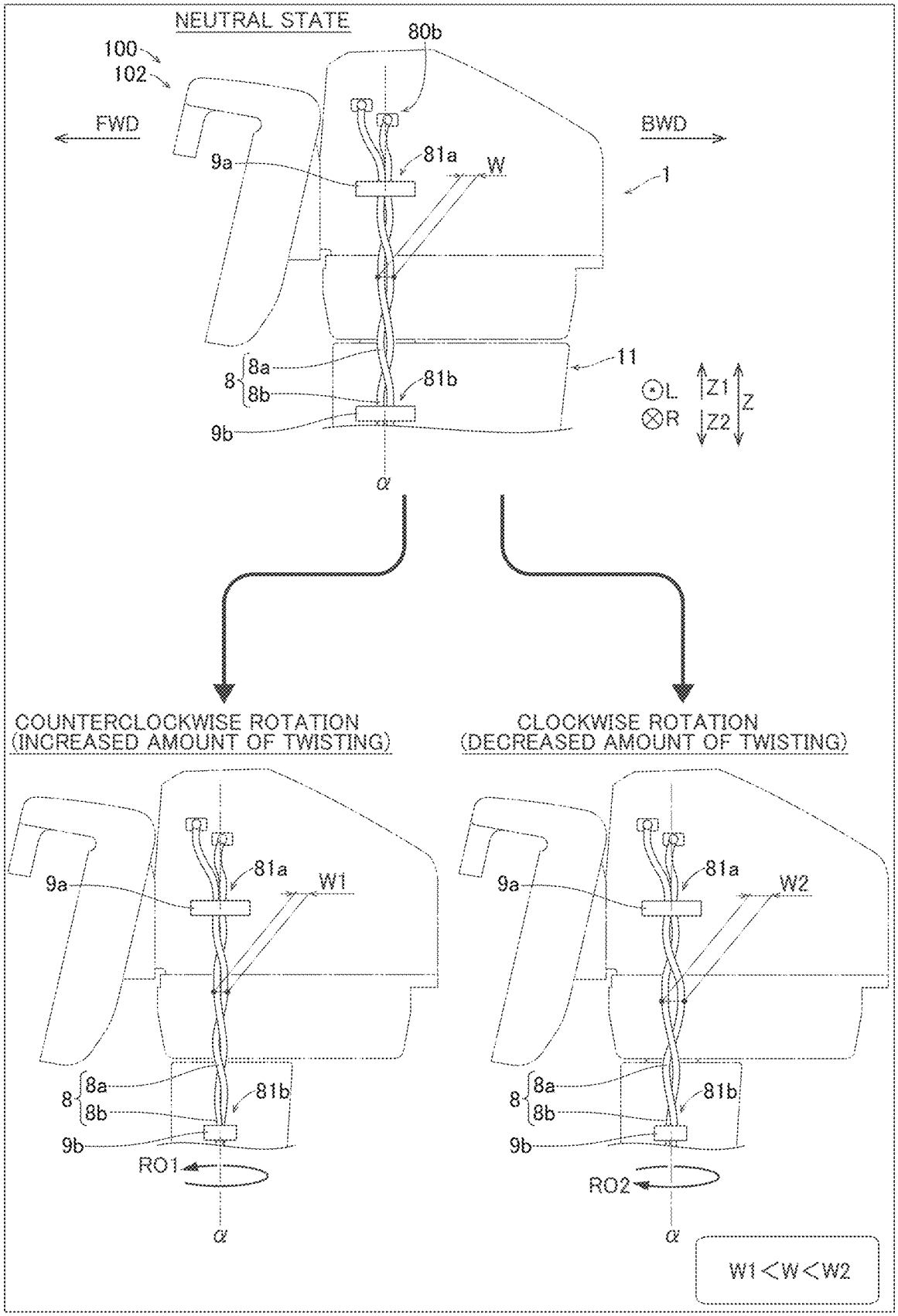
FIG. 2 is a diagram for illustrating twist of two power lines during rotation of a marine propulsion device.

As shown in FIG. 2, the two power lines 8 are held and spaced apart by a distance that allows the amount of twisting to be further increased during rotation by the steering mechanism 2 in the neutral state in which the direction of the thrust of the propeller 5 is parallel to the forward-rearward direction of the hull 101. In the neutral state, the propeller 5 is not rotated to the left or right by the steering mechanism 2.

The two power lines 8 extend through the cylindrical steering shaft 23 in a mutually twisted state so as to absorb twisting during rotation by the steering mechanism 2. The twisted portions of the two power lines 8 extend linearly in the upward-downward direction along the axial center α of the cylindrical steering shaft 23.

The two power lines 8 are twisted together in directions such that the phases of the positive line 8*a* and the negative line 8*b* about the axial center α shift more counterclockwise downward along the axial center α. The twisting directions of the two power lines 8 maybe opposite to the above.

The upper ends 81*a* of the twisted portions of the two power lines 8 are located inside the upper case 10, and are bundled and restrained by the upper restrainer 9*a* within the upper case 10. The two power lines 8 are not twisted together above the upper restrainer 9*a*.

The lower ends 81*b* of the twisted portions of the two power lines 8 are located inside the lower case 11, and are bundled and restrained by the lower restrainer 9*b* within the lower case 11. The two power lines 8 are not twisted together below the lower restrainer 9*b*. The two power lines 8 extend toward the motor controller 3 while curving along a horizontal or substantially horizontal direction below the lower restrainer 9*b*.

Movement of the two power lines 8 during rotation by the steering mechanism 2 is now described.

First, a case is described in which the propeller 5 etc. are rotated counterclockwise by the steering mechanism 2. That is, a case is described in which the amount of twisting of the two power lines 8 increases. The amount of twisting of the two power lines 8 increases as the two power lines 8 become closer together in a direction perpendicular to a direction in which the two power lines 8 extend when the case 1 (lower case 11) is rotated from the neutral state to a first side in the right-left direction by the steering mechanism 2. Consequently, in the horizontal direction of the two power lines 8, the two power lines 8 change from a spaced apart width W to a spaced apart width W1 that is smaller than the width W (W1<W). In the direction (Z direction) in which the two power lines 8 extend, the width of the two power lines 8 changes over substantially the entire twisted portions of the two power lines 8 when the propeller 5 etc. are rotated counterclockwise by the steering mechanism 2.

Next, a case is described in which the propeller 5 etc. are rotated clockwise by the steering mechanism 2. That is, a case is described in which the amount of twisting of the two power lines 8 decreases. The amount of twisting of the two power lines 8 decreases as the two power lines 8 become farther apart in the direction perpendicular to the direction in which the two power lines 8 extend when the case 1 (lower case 11) is rotated from the neutral state to a second side in the right-left direction by the steering mechanism 2. Consequently, in the horizontal direction of the two power lines 8, the two power lines 8 change from the spaced apart width W to a spaced apart width W2 that is larger than the width W (W<W2). As described above, the two power lines 8 become farther apart such that a portion of a twisting motion applied to the two power lines 8 is converted into a bending motion. Therefore, as compared with a case in which the two power lines are straight without being twisted, the amount by which the two power lines 8 are twisted per unit length is decreased. In the direction (Z direction) in which the two power lines 8 extend, the width between the two power lines 8 changes over substantially the entire twisted portions of the two power lines 8 when the propeller 5 etc. are rotated clockwise by the steering mechanism 2.

According to the various example embodiments of the present invention described above, the following advantageous effects are achieved.

According to an example embodiment of the present invention, the marine propulsion device 102 includes the two power lines 8 including the positive line 8*a* and the negative line 8*b* to supply driving electric power to the motor controller 3, and the two power lines 8 are twisted together inside at least the case 1 so as to absorb twisting during rotation by the steering mechanism 2. Accordingly, when the propeller 5 is rotated in the right-left direction by the steering mechanism 2, the amount of twisting of the two power lines 8 is decreased when the propeller 5 is rotated to at least the first side in the right-left direction, and thus loads on the two power lines 8 are reduced or prevented. Therefore, as compared with a conventional structure in which the amount of twisting of power lines increases (loads increase) even when a propeller is rotated in either a right or left direction, loads on the power lines 8 connected to the motor controller 3 are decreased when the propeller 5 is rotated in the right-left direction by the steering mechanism 2.

According to an example embodiment of the present invention, in the neutral state in which the direction of the thrust of the propeller 5 is parallel to the forward-rearward direction of the hull 101, the two power lines 8 are spaced apart by a distance that allows the amount of twisting to be further increased during rotation by the steering mechanism 2. Accordingly, there is a distance between the two power lines 8 that allows the amount of twisting to be further increased during rotation by the steering mechanism 2, and thus loads on the power lines 8 connected to the motor controller 3 during rotation by the steering mechanism 2 are decreased.

According to an example embodiment of the present invention, the amount of twisting of the two power lines 8 increases as the two power lines 8 become closer together in the direction perpendicular to the direction in which the two power lines 8 extend when the case 1 is rotated from the neutral state to the first side in the right-left direction by the steering mechanism 2, and the amount of twisting of the two power lines 8 decreases as the two power lines 8 become farther apart in the direction perpendicular to the direction in which the two power lines 8 extend when the case 1 is rotated from the neutral state to the second side in the right-left direction by the steering mechanism 2. Accordingly, the two power lines 8 are farther spaced apart in the direction perpendicular to the direction in which the two power lines 8 extend such that twisting forces acting on the two power lines 8 are decreased. Consequently, loads on the power lines 8 connected to the motor controller 3 during rotation by the steering mechanism 2 are further decreased.

According to an example embodiment of the present invention, the steering mechanism 2 includes the cylindrical steering shaft 23, and the two power lines 8 pass through the cylindrical steering shaft 23 in a mutually twisted state so as to absorb twisting during rotation by the steering mechanism 2. Accordingly, the two power lines 8 pass through the cylindrical steering shaft 23, and thus deformation of the two power lines 8 into shapes different from shapes along the steering shaft 23, such as a large deformation of only portions of the two power lines 8, occurring during rotation by the steering mechanism 2 is reduced or prevented.

According to an example embodiment of the present invention, the cylindrical steering shaft 23 extends in the upward-downward direction, and the twisted portions of the two power lines 8 extend linearly in the upward-downward direction along the axial center $\alpha$ of the cylindrical steering shaft 23.

Accordingly, the two power lines 8 extend linearly in the upward-downward direction along the axial center $\alpha$ of the cylindrical steering shaft 23, and thus as compared with a case in which the two power lines 8 include bent or curved portions, loads on the power lines 8 connected to the motor controller 3 during rotation by the steering mechanism 2 are further decreased.

According to an example embodiment of the present invention, the case 1 includes the upper case 10 and the lower case 11 below the upper case 10 to house the motor controller 3, the steering mechanism 2 is operable to integrally rotate the propeller 5, the electric motor 6, and the lower case 11 in the right-left direction with respect to the upper case 10, and the two power lines 8 include the upper ends 81*a* of the twisted portions inside the upper case 10, and the lower ends 81*b* of the twisted portions inside the lower case 11. Accordingly, even when the two power lines 8 straddle the upper case 10 that does not rotate and the lower case 11 that does rotate, loads on the power lines 8 connected to the motor controller 3 during rotation by the steering mechanism 2 are decreased.

According to an example embodiment of the present invention, the marine propulsion device 102 further includes the upper restrainer 9*a* to bundle and restrain the upper ends 81*a* of the twisted portions of the two power lines 8 within the upper case 10, and the lower restrainer 9*b* to bundle and restrain the lower ends 81*b* of the twisted portions of the two power lines 8 within the lower case 11. Accordingly, the amount of twisting of the two power lines 8 are maintained at an appropriate amount between the upper restrainer 9*a* and the lower restrainer 9*b*.

According to an example embodiment of the present invention, the lower restrainer 9*b* is fixed to the inner surface 11*a* of the lower case 11. Accordingly, the lower restrainer 9*b*allows the amount of twisting of the lower ends 81*b* of the twisted portions of the two power lines 8 to be maintained at an appropriate amount up to the location of the inner surface 11*a*of the lower case 11.

According to an example embodiment of the present invention, the upper case 10 includes the steering box 10*c*including the steering mechanism 2 therein, and the cowling 10*b*above the steering box 10*c*, the marine propulsion device 102 further includes the terminal case T inside the cowling 10*b* to connect to the second ends 80*b* of the two power lines 8, and the upper restrainer 9*a* is fixed to the terminal case T.

Accordingly, the upper restrainer 9*a* allows the amount of twisting of the upper ends 81*a* of the twisted portions of the two power lines 8 to be maintained at an appropriate amount up to the location of the terminal case T.

According to an example embodiment of the present invention, both the upper restrainer 9*a* and the lower restrainer 9*b* are made of an elastically deformable material. Accordingly, the upper restrainer 9*a* and the lower restrainer 9*b* are elastically deformed, and thus damage to the two power lines 8 by the upper restrainer 9*a* and the lower restrainer 9*b* is prevented.

According to an example embodiment of the present invention, the lower restrainer 9*b* is located at the height between the upper end 3*a* of the motor controller 3 and the lower end 3*b* of the motor controller 3, and the two power lines 8 extend toward the motor controller 3 while curving along the horizontal or substantially horizontal direction below the lower restrainer 9*b*. Accordingly, the two power lines 8 are easily connected to the motor controller 3 by being located relatively close to the motor controller 3 below the lower restrainer 9*b*.

According to an example embodiment of the present invention, the marine propulsion device 102 further includes the signal line 7 connected to the motor controller 3 to transmit a control signal to the motor controller 3, and thinner than the power lines 8, the signal line 7 is located along the two power lines 8 without being twisted with the two power lines 8 that are twisted together, and the upper restrainer 9*a* and the lower restrainer 9*b* are operable to bundle and restrain the signal line 7 together with the two power lines 8. Accordingly, the signal line 7 is located along the two power lines 8 between the upper restrainer 9*a* and the lower restrainer 9*b*, and thus interference of expansion and contraction of twisting of the two power lines 8 by the signal line 7 due to partial deformation of the signal line 7 caused by twisting between the upper restrainer 9*a* and the lower restrainer 9*b* is reduced or prevented.

According to an example embodiment of the present invention, the marine propulsion device 102 further includes the cylindrical duct attached to the lower portion of the case 1 and including the propeller 5 therein, and the electric motor 6 includes the stator 60 in the duct and the rotor 61 in the propeller 5. Accordingly, in the duct-driven marine propulsion device 102 in which the electric motor 6 is provided in the duct and the propeller 5, loads on the power lines 8 connected to the motor controller 3 during rotation by the steering mechanism 2 are decreased.

The example embodiments of the present invention described above are illustrative in all points and not restrictive. The extent of the present invention is not defined by the above description of the example embodiments but by the scope of the claims, and all modifications within the meaning and range equivalent to the scope of the claims are further included.

For example, while the marine propulsion device preferably includes an outboard motor in example embodiments described above, the present invention is not restricted to this. In an example embodiment of the present invention, the marine propulsion device may alternatively include an inboard motor or an inboard-outboard motor.

While only a portion (the lower case and the duct) of the propulsion device body is preferably rotated in the right-left direction by the steering mechanism in example embodiments described above, the present invention is not restricted to this. In an example embodiment of the present invention, the entire propulsion device body (including the lower case, the duct, the upper case, etc.) may alternatively be rotated in the right-left direction by the steering mechanism. In such a case, the motor controller may be housed in the upper case.

While the upper restrainer and the lower restrainer preferably include grommets in example embodiments described above, the present invention is not restricted to this. In an example embodiment of the present invention, the upper restrainer and the lower restrainer may alternatively include other restrainers such as insulation locks.

While the upper restrainer and the lower restrainer preferably restrain the signal line in addition to the two power lines in example embodiments described above, the present invention is not restricted to this. In an example embodiment of the present invention, the upper restrainer and the lower restrainer may alternatively restrain only the two power lines.

While the second ends of the two power lines are preferably connected to the terminal case in example embodiments described above, the present invention is not restricted to this. In an example embodiment of the present invention, the second ends of the two power lines may alternatively be introduced into the hull without going through the terminal case.

While the marine propulsion device preferably includes the upper restrainer and the lower restrainer in example embodiments described above, the present invention is not restricted to this. In an example embodiment of the present invention, the marine propulsion device may not include one of the upper restrainer and the lower restrainer, or both the upper restrainer and the lower restrainer.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

a propeller;

an electric motor to drive the propeller;

a motor controller configured or programmed to control driving of the electric motor;

a case to house the motor controller;

a steering mechanism to integrally rotate the propeller, the electric motor, and the case in a right-left direction; and two power lines including first ends connected to the motor controller, and positive and negative lines to supply driving electric power to the motor controller; wherein the two power lines are twisted together inside at least the case so as to absorb twisting of the two power lines during rotation by the steering mechanism;

the case includes an upper case and a lower case below the upper case to house the motor controller;

the steering mechanism is operable to integrally rotate the propeller, the electric motor, and the lower case in the right-left direction with respect to the upper case;

the two power lines include upper ends inside the upper case, and lower ends inside the lower case; and the marine propulsion device further comprises:

an upper restrainer to bundle and restrain the upper ends of the two power lines within the upper case; and a lower restrainer to bundle and restrain the lower ends of the two power lines within the lower case.

2. The marine propulsion device according to claim 1, wherein the lower restrainer is fixed to an inner surface of the lower case.

3. The marine propulsion device according to claim 1, wherein the upper case includes a steering box to house the steering mechanism, and a cowling above the steering box;

the marine propulsion device further comprises a terminal case inside the cowling and connected to second ends of the two power lines; and the upper restrainer is fixed to the terminal case.

4. The marine propulsion device according to claim 1, wherein both the upper restrainer and the lower restrainer are made of an elastically deformable material.

5. The marine propulsion device according to claim 1, wherein the lower restrainer is located at a height between an upper end of the motor controller and a lower end of the motor controller; and the two power lines extend toward the motor controller while curving along a horizontal or substantially horizontal direction below the lower restrainer.

6. The marine propulsion device according to claim 1, further comprising:

a signal line connected to the motor controller to transmit a control signal to the motor controller, and being thinner than each of the two power lines; wherein the signal line is located along the two power lines without being twisted with the two power lines; and the upper restrainer and the lower restrainer are operable to bundle and restrain the signal line together with the two power lines.

7. The marine propulsion device according to claim 1, further comprising:

a cylindrical duct attached to a lower portion of the case and including the propeller therein; wherein the electric motor includes a stator in the duct and a rotor in the propeller.

8. The marine propulsion device according to claim 1, wherein, in a neutral state in which a direction of a thrust of the propeller is parallel to a forward-rearward direction of a hull, the two power lines are spaced apart by a distance that allows an amount of twisting to be increased during the rotation by the steering mechanism.

9. The marine propulsion device according to claim 8, wherein the amount of twisting of the two power lines increases as the two power lines become closer together in a direction perpendicular to a direction in which the two power lines extend when the case is rotated from the neutral state to a first side in the right-left direction by the steering mechanism; and the amount of twisting of the two power lines decreases as the two power lines become farther apart in the direction perpendicular to the direction in which the two power lines extend when the case is rotated from the neutral state to a second side in the right-left direction by the steering mechanism.

10. The marine propulsion device according to claim 1, wherein the steering mechanism includes a cylindrical steering shaft; and the two power lines extend through the cylindrical steering shaft in a mutually twisted state so as to absorb the twisting during the rotation by the steering mechanism.

11. The marine propulsion device according to claim 10, wherein the cylindrical steering shaft extends in an upward-downward direction; and the two power lines include twisted portions extending linearly in the upward-downward direction along an axial center of the cylindrical steering shaft.

12. A marine vessel comprising:

a hull; and a marine propulsion device attached to the hull; wherein the marine propulsion device includes:

a propeller;

an electric motor to drive the propeller;

a motor controller configured or programmed to control driving of the electric motor;

a case to house the motor controller;

a steering mechanism to integrally rotate the propeller, the electric motor, and the case in a right-left direction; and two power lines including first ends connected to the motor controller, and including positive and negative lines to supply driving electric power to the motor controller;

the two power lines are twisted together inside at least the case so as to absorb twisting of the two power lines during rotation by the steering mechanism;

the case includes an upper case and a lower case below the upper case to house the motor controller;

the steering mechanism is operable to integrally rotate the propeller, the electric motor, and the lower case in the right-left direction with respect to the upper case;

the two power lines include upper ends of twisted portions inside the upper case, and lower ends of the twisted portions inside the lower case; and the marine propulsion device further includes:

an upper restrainer to bundle and restrain the upper ends of the twisted portions of the two power lines within the upper case; and a lower restrainer to bundle and restrain the lower ends of the twisted portions of the two power lines within the lower case.

13. The marine vessel according to claim 12, wherein, in a neutral state in which a direction of a thrust of the propeller is parallel to a forward-rearward direction of the hull, the two power lines are spaced apart by a distance that allows an amount of twisting to be increased during the rotation by the steering mechanism.

14. The marine vessel according to claim 13, wherein the amount of twisting of the two power lines increases as the two power lines become closer together in a direction perpendicular to a direction in which the two power lines extend when the case is rotated from the neutral state to a first side in the right-left direction by the steering mechanism; and the amount of twisting of the two power lines decreases as the two power lines become farther apart in the direction perpendicular to the direction in which the two power lines extend when the case is rotated from the neutral state to a second side in the right-left direction by the steering mechanism.

15. The marine vessel according to claim 12, wherein the steering mechanism includes a cylindrical steering shaft; and the two power lines extend through the cylindrical steering shaft in a mutually twisted state so as to absorb the twisting during the rotation by the steering mechanism.

16. The marine vessel according to claim 15, wherein the cylindrical steering shaft extends in an upward-downward direction; and the two power lines include twisted portions extending linearly in the upward-downward direction along an axial center of the cylindrical steering shaft.

* * * * *